US008350472B2

(12) United States Patent
Chen et al.

(10) Patent No.: US 8,350,472 B2
(45) Date of Patent: Jan. 8, 2013

(54) HIGH VOLTAGE SWITCH TRIGGERED BY A LASER-PHOTOCATHODE SUBSYSTEM

(75) Inventors: Ping Chen, Rancho Palos Verdes, CA (US); Martin L. Lundquist, Rancho Palos Verdes, CA (US); David U. L. Yu, Rancho Palos Verdes, CA (US)

(73) Assignee: DULY Research Inc., Rancho Palos Verdes, CA (US)

( * ) Notice: Subject to any disclaimer, the term of this patent is extended or adjusted under 35 U.S.C. 154(b) by 141 days.

(21) Appl. No.: 12/660,890

(22) Filed: Mar. 4, 2010

(65) Prior Publication Data

US 2011/0215717 A1 Sep. 8, 2011

(51) Int. Cl.
*H01J 40/06* (2006.01)
*H01J 9/24* (2006.01)

(52) U.S. Cl. ..... 313/542

(58) Field of Classification Search ..... 313/542
See application file for complete search history.

(56) References Cited

U.S. PATENT DOCUMENTS 4,916,303 A * 4/1990 Schoenbach et al. ..... 250/214.1
5,930,331 A * 7/1999 Rentzepis et al. ..... 378/136
2005/0045866 A1* 3/2005 Kan et al. ..... 257/11

OTHER PUBLICATIONS

"Synchronizable High Voltage Pulser with Laser-Photocathode Trigger" to P. Chen published Jun. 25-29, 2007 in Particle Accelerator Conference, 2007. PAC, IEEE.*

* cited by examiner

*Primary Examiner* — Anh Mai
*Assistant Examiner* — Zachary J Snyder

(57) ABSTRACT

A spark gap switch for controlling the output of a high voltage pulse from a high voltage source, for example, a capacitor bank or a pulse forming network, to an external load such as a high gradient electron gun, laser, pulsed power accelerator or wide band radar. The combination of a UV laser and a high vacuum quartz cell, in which a photocathode and an anode are installed, is utilized as triggering devices to switch the spark gap from a non-conducting state to a conducting state with low delay and low jitter.

2 Claims, 4 Drawing Sheets

HIGH VOLTAGE SWITCH TRIGGERED BY A LASER-PHOTOCATHODE SUBSYSTEM

GOVERNMENT RIGHTS

This invention was made with government support under Grant No. DE-FG03-02ER83402 awarded by the U.S. Energy Department. The government may have certain rights in the invention.

BACKGROUND OF THE INVENTION

1. Field of the Invention

The present invention provides a high voltage spark gap switch controlled by a laser-photocathode subsystem. A double-triggering mechanism is used for reliably closing the spark gap switch while keeping the low jitter properties of the laser triggering.

2. Description of Prior Art

High voltage switch is one of the elementary devices employed in pulsed power techniques. Ideally, it controls the flow of current in a circuit in two states: either the current flows at a value determined by the other components in series with it, or the current does not flow at all. There are many considerations when choosing a switch; for example, large current and/or voltage handling capacity, compact size, price, durability and reliability. A switch with minimized delay and jitter is also needed in many applications.

A spark gap is one of the most widely used switches. It is relatively simple to build and easy to operate and its application range is flexible. It can conduct current from a few tens of amperes to multi-mega amperes and it can also withstand voltages up to several megavolts. The basic spark gap usually consists of two current-carrying electrodes separated by a gap filled with isolating medium, which is made to break down by overvolting the gap or by some other means such as applying a triggering pulse through a third electrode, i.e. a trigger electrode, injecting an electron beam or shining an optical beam into the gap.

Different methods of inducing electrical breakdown in the spark gap have their own advantages and drawbacks. For example, the electrical pulse triggered switch is comparably simple, but it needs a separate electrical pulse generator, and the delay and jitter of the breakdown induced by this method are relatively larger. For precise timing and synchronization, the laser-triggered switch has been extensively studied in the past several decades. Though great progress has been made, some problems remain for the laser-triggered switches. One of them is how to make use of laser optical energy efficiently because many mediums used in the spark gap are transparent and their absorption coefficients are rather low to the photons generated by a common laser source whose wavelength is in ultra-violet (UV) spectrum or longer. For example, $SF_6$ and $N_2$ are two of the most often used gaseous mediums in spark gap switches. But neither $SF_6$ nor $N_2$ under standard conditions has an absorption coefficient higher than 0.002/cm for the photons with a wavelength of 186 nm. It means that the ratio of the photons absorbed by the gases to the total photons in the laser beam is less than 6% after the laser beam with the wavelength passes through a 30-cm-long gas channel. Moreover, the number of absorbed photons tends to decrease with the increment of the photon wavelength in UV spectrum. Therefore, most of photons in the laser beam passing through a common gas gap whose length is generally less than 30 cm simply waste their optical energy. For this reason, a high-energy laser system is needed to trigger a traditional high voltage spark gap switch, thus incurring a very high cost for the laser system. Otherwise, the delay time and the jitter of the switch will be adversely impacted.

One of the purposes of this invention is to seek a viable method to convert the leftover optical energy of the laser beam to actual triggering energy in order that the laser energy can be utilized efficiently. In the mean time, depressing the jitter of a spark gap switch as well as closing it reliably is the concern of current invention, too. Further objects and advantages of the invention will become apparent from a consideration of the drawings and ensuing description.

U.S. Pat. No. 5,057,740 to George et al. describes the use of photoelectrons to trigger a backlight thyratron switch. The switch exposes photoemission materials having very low quantum efficiency directly to a low-pressure gas. The working range of their switch is limited to only the left hand side of the Paschen curve. The lifetimes of the photoemission materials are also limited. Furthermore, the medium in such switches can only be gases.

SUMMARY OF THE INVENTION

The present invention incorporates the advantages of the electrically triggered spark gap switches, which are relatively simple and easy to operate, with the merits of the laser triggered spark gap switches, which have less breakdown delay and jitter and which can be decoupled from the main switching circuit. It provides a high voltage switch that can be operated reliably through a double triggering mechanism. Such a switch will make use of the laser optical energy more efficiently.

The present invention utilizes a photocathode to collect the leftover optical energy of the laser beam in a laser triggered spark gap switch and convert the energy to photoelectron emissions. After the emitted photoelectrons are collected by an anode, they are used as additional electrical triggering power in a similar way as the conventional electrical triggering spark gaps. In this way, the laser energy is not only utilized more efficiently, but it also provides a second triggering power to secure the closing of the switch. Compared with the switches using laser beam triggering only, the switch in the present invention is expected to have less delay and jitter because more triggering energy is fed back into the spark gap.

The switch in the present invention consists of an ultraviolet (UV) laser system and a housing, in which all components of a spark gap and a high vacuum transparent cell are installed. The spark gap comprises a plurality of main electrodes and trigger electrodes, no external electrical triggering pulse generator being required. A first laser beam enters the switch housing through a window on the sidewall for the initial triggering of the spark gap. A second laser beam, which can be the continuation of the leftover of the first laser beam, enters a small transparent cell containing a photocathode and an anode. The transparent cell is made of a durable material such as quartz. It is pumped to high vacuum before being sealed and is installed beside the two main electrodes of the spark gap and is located in the opposite side to the laser window relative to the gap region. The photocathode and the anode are electrically connected to a lower-potential main electrode of the gap and to the trigger electrode of the switch respectively.

In operation to close the switch, the first triggering pulse, the laser beam, is incident into the gap medium region where it ionizes a portion of the medium. After the beam passes through the region, it enters the vacuum cell and is incident on the surface of the photocathode. The beam will generate a great number of photoelectrons. Under the action of the electric field, the photoelectrons move toward the anode and are collected by it. The photoelectrons produce a voltage between the trigger electrode and the higher-potential main electrode. Depending on the capacitance between the two electrodes, the voltage can be so high that it acts as a second triggering pulse to cause a fast breakdown first in the gap between the trigger electrode and the higher potential main electrode, and finally a major breakdown in the gap between the two main electrodes.

Two embodiments of the switch are disclosed in the present invention. The first embodiment is a trigatron type gap switch combined with a triggering laser. In the switch, a trigger electrode is located in the axis of the higher-potential main electrode. The second embodiment is a field distortion type gap switch combined with a triggering laser. In this switch, two electrically connected trigger electrodes are placed at opposite positions relative to the axis of the two main electrodes and both of them are near the higher-potential main electrode. Both embodiments need isolating medium to prevent a stochastic voltage breakdown and both of them adopt high quantum efficiency photocathodes. A UV laser system, e.g. Q-switch Nd:YAG laser operating at its fourth harmonic of 1064 nm, is also required to provide the triggering pulse. To diminish the jitter of the entire switch, the laser system should have a very low jitter. Commercial laser systems have the ability to control jitters on the order of picoseconds or lower.

For both embodiments, a moderate energy laser system is sufficient to provide the energy and the amplitude of the photoelectron triggering voltage pulse needed to induce electrical breakdown in the gaps.

The switch of the present invention can be used in pulsed-power accelerators, weapon effect simulators, fusion research devices, lasers and synchronizable high voltage pulsers. These systems require spark gap reliability, fast energy transfer rates, and low jitter. For example, a high-gradient dc/rf electron gun in accelerator research field needs a low jitter pulser in order to synchronize the voltage pulse with its electron bunch extractions whose durations last only several picoseconds. A high voltage pulse of short duration produced using the switch in the present invention can be applied to the acceleration gap of the pulsed dc gun.

DESCRIPTION OF THE DRAWINGS

For a better understanding of the present invention and further features thereof, reference is made to the following descriptions which are to be read in conjunction with the accompanying drawings wherein.

DESCRIPTION OF THE INVENTION

Figure 1:
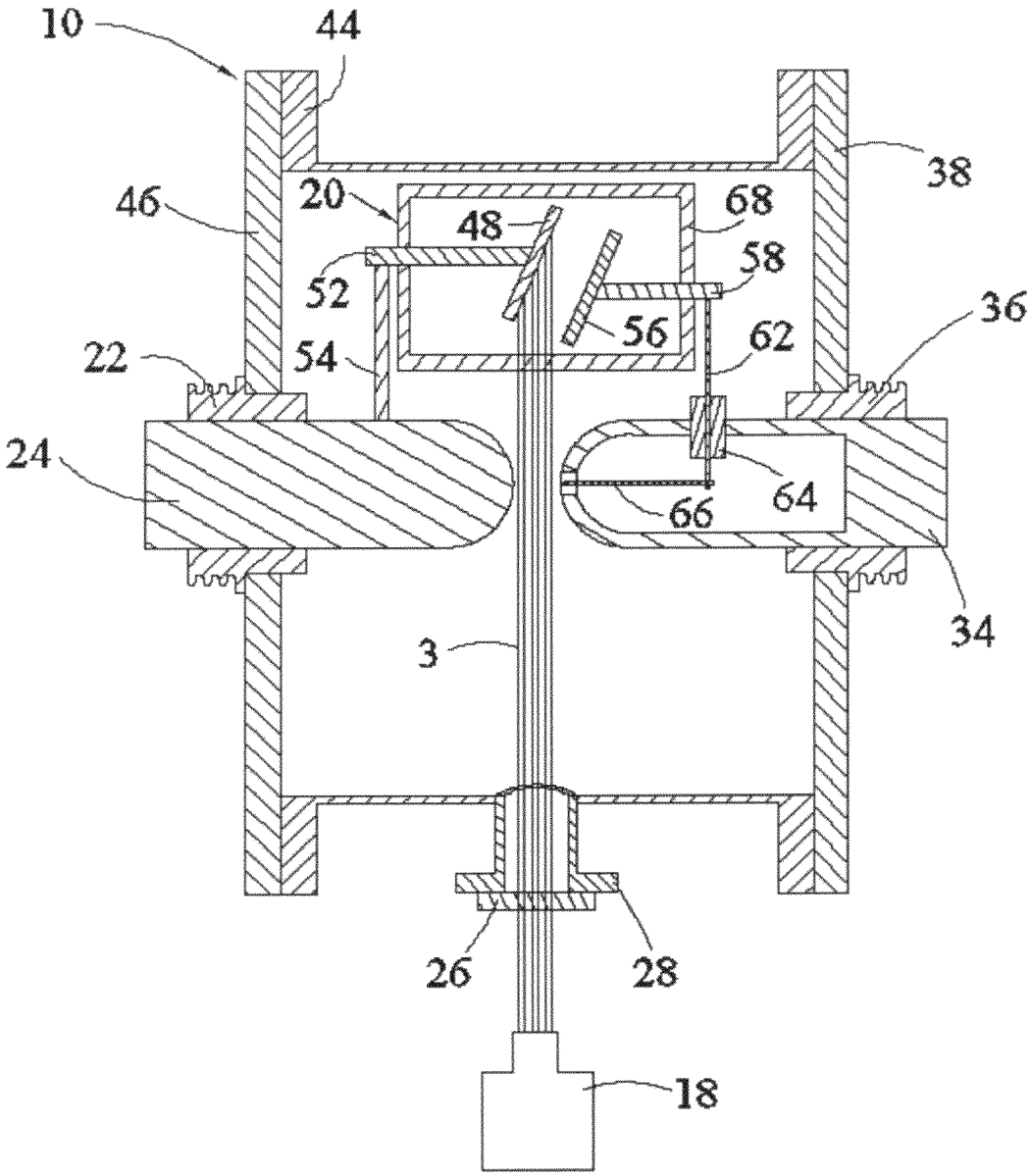
FIG. 1 is a view of the first embodiment of the present invention.

Referring to FIG. 1, the first embodiment of the switch of the present invention is illustrated. It comprises an UV laser coupled with optical system 18 and a gas-tight housing 10.

The UV laser system need have a short pulse width, e.g. on the order of hundreds of picoseconds or shorter. Under this circumstance, all of its pulse optical energy can be output in a very short time. Such an UV laser system can be found from common commercial products, too. Numeral 3 in FIG. 1 indicates the laser beam emitted from the UV laser system 18.

The sealed housing 10 consists of a sidewall 44, end cover 38 and end cover 46. It is full of high voltage isolating mediums such as gases, water or even low vacuum. Cylindrical main electrodes 24 and 34 are welded with high voltage ceramic insulators 22 and 36 individually, while the high voltage insulators 22 and 36 are secured on the end covers 46 and 38, respectively. The main electrodes 24 and 34 are made of a highly conductive and durable electrode material, e.g. brass. Main electrode 34 has a higher potential compared to the main electrode 24. Trigger electrode 66 is made by a rod and it is set on the axis of the main electrode 34. A laser window 28 is opened on the sidewall 44. It is covered by a quartz window plate 26 that is transparent to UV laser beams.

There is a high vacuum cell 20 inside the housing 10. The vacuum cell 20 comprises a photocathode 48 supported by a metallic supporter 52 and an anode supported by the second metallic supporter 58. Another metallic support 54 not only supports the cell 20 securely, but also connects the photocathode 48 to the main electrode 24 electrically. Opposite to the photocathode 48, the anode 56 is installed. The anode 56 is also connected to the trigger electrode 66 electrically through the metallic support 58 and a conductive wire 62, while an insulator 64 electrically isolates the circuit of the trigger electrode 66 from the main electrode 34. The wall of the cell 20 is made of quartz or any other durable transparent materials that can withstand certain inward pressure. The cell 20 is hermetically sealed, but before the sealing, it is pumped to a vacuum better than $10^{-9}$ torr because only in a high vacuum environment, the photocathode 48 can have sufficiently long lifetime. It is also an advantage to avoid undesirable electrical breakdowns between the photocathode 48 and the anode 56 under high vacuum condition. The preferential materials for the photocathode 48 are those of having high quantum efficiency in UV light such as Magnesium.

Figure 2:
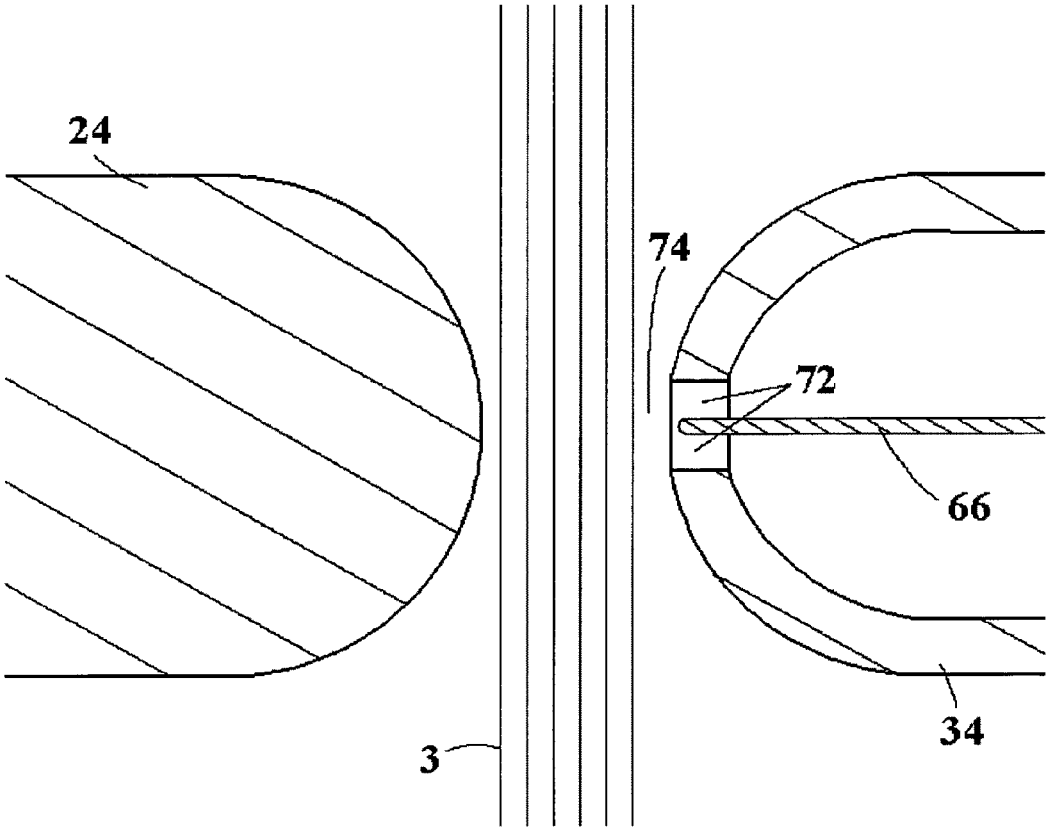
FIG. 2 is the magnification of the main spark gap portion for the first embodiment.

FIG. 2 magnifies the gap defined by the main electrodes 24 and 34 of the first embodiment that is shown in FIG. 1. In FIG. 2, main spark gap 74 refers to the space between the main electrode 24 and the main electrode 34. Trigger gap 72 refers to the space between the main electrode 34 and the trigger electrode 66.

In an operation to close the switch, the laser beam 3 is first directed into the main spark gap 74, where one portion of the beam optical energy is absorbed by the gap medium and makes some of the medium ionization. However, most energy of the laser beam 3 will reach the surface of the photocathode 48 in the cell 20 since the gap medium that is for holding a high stand-off gap voltage is nearly fully transparent to the UV laser beam, as analyzed in the previous paragraph. The beam will extract a great number of photoelectrons from the surface of the photocathode 48. Then, the photoelectrons will move toward the anode 56 under the attraction force of the electric field. Those photoelectrons will be collected by the anode 56 finally and, along the metallic connection, reach the trigger electrode 66, where they will enhance the localized electric field in the trigger gap 72. Depending on the quantity of the photoelectrons collected and the capacitance between the circuit of the trigger electrode 66 and the main electrode 34, the enhancement of the field can be so strong that the trigger gap 72 will break down immediately, which, like those of conventional electrical triggering, will further induce a large amount of active ions to the main spark gap 74 and cause the major breakdown in the main spark gap 74 if such a breakdown does not happen yet during the laser beam triggering. This is our so-called second time triggering mechanism. It leads more activating energy into the main gap 74 compared with the laser beam triggering only and thus ensures the occurrence of the major breakdown that closes the spark gap switch reliably.

Calculations on one concrete example of the first embodiment were performed. In this example, a Q-switch Nd:YAG laser operating at its fourth harmonic of 1064-nm with pulsed energy at 4 mJ and a pulse width at 100 ps is adopted to trigger a 200 kV switch. $SF_6$ gas with a pressure at one atmosphere is filled in the switch as isolating medium. The calculations are performed mainly on the following aspects:

(1) Total Charge Extracted by the Laser Beam

From the analysis in prior paragraph, it is theorized that 80% of laser beam energy, i.e. 3.2 mJ, arrives at the surface of the photocathode 48 finally. There will be $4.29\times10^{15}$ photons reaching the cathode per laser pulse because the energy of a single photon is $6.64\times10^{-19}$ J for 266-nm light. Mg cathode's quantum efficiency is around $5\times10^{-4}$ at this wavelength. Thus, the number of photoelectrons generated by the residual energy of the laser beam would be $2.14\times10^{12}$. The total charge, $Q_{pe}$, of the photoelectrons is about $-3.43\times10^{-7}$ Coulomb.

(2) The Lowest Voltage Generated by the Photoelectrons Above Over the Trigger Gap 72

The lowest voltage, $V_{pe}$, produced by the photoelectrons between the main electrode 34 and the circuit of the trigger electrode 66 depends not only on the total charge $Q_{pe}$, but also on the capacitance between the two electrodes' circuits. The capacitance, $C_{trig}$, composes three parts: (a) $C_1$, a capacitance between the trigger electrode 66 and the main electrode 34; (b) $C_2$, a capacitance between the anode 56 and the main electrode 34; (c) $C_3$, the stray capacitance of the connecting wire.

Figure 3:
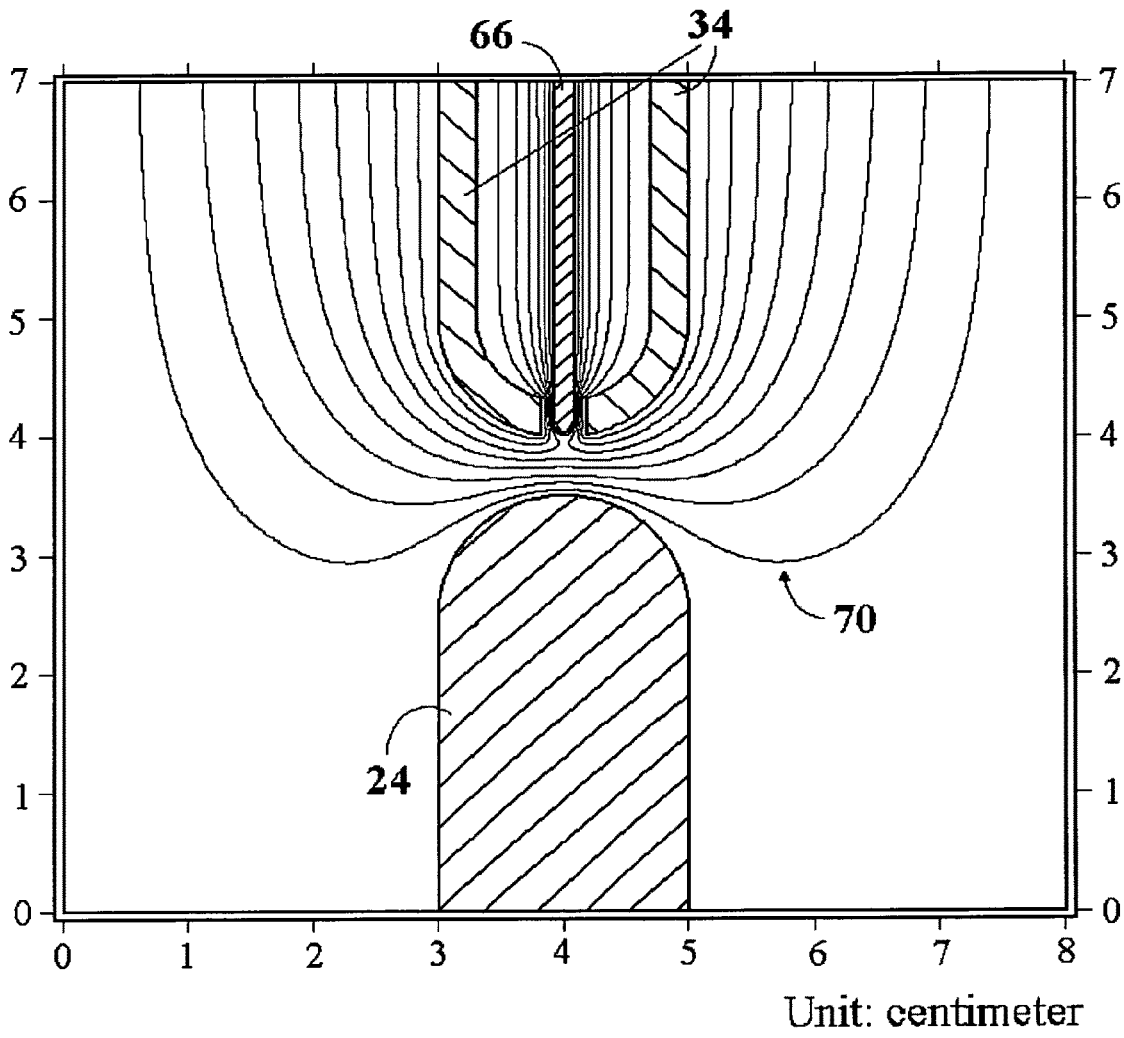
FIG. 3 is a model for the first embodiment to calculate the properties of the photoelectron triggering pulse.

$C_1$ was computed based on the model indicated in FIG. 3. The value of $C_1$ is about $9.44\times10^{-13}$ F according to this model. The largest value of the $C_2$ was estimated to be $6.26\times10^{-13}$ F based on a simplified parallel plate capacitor model, in which the radius of the anode 56 is 1.5 cm and the smallest gap between the anode 56 and the main electrode 34 is 1 cm. Actually, $C_3$ is flexible and can be minimized by several methods such as increasing the radius of the hole that leads wire inside the main electrode 34 and choosing a connecting wire with a proper small radius. After such managements, the value of $C_3$ for a 4-cm-long wire was estimated to be less than $5\times10^{-13}$ F if the radius of the wire is no larger than 1 mm in this example. Therefore, the overall capacitance, $C_{trig}$, for the circuit of the trigger electrode 66 should be smaller than $2.07\times10^{-12}$ F and thus $$V_{pe} = \frac{|Q_{pe}|}{C_{trig}} = 165.7 \text{ kV}.$$

In FIG. 3, the group of curves represented by numeral 70 are electric field potential lines generated by the SUPERFISH code, a prior art program known in the accelerator research field and developed by Los Alamos National Laboratory, which show the distributions of the field around the three electrodes when the $V_{pe}$ reaches 165.7 kV. The much higher density of the potential lines in the trigger gap than that in the main spark gap indicates that the most possible first breakdown position.

The value of the $V_{pe}$ above is apparently very high even when it is compared to that of the switching voltage between the main electrodes 24 and 34, which is 200 kV in this example, although the $V_{pe}$ can't be higher than 200 kV because the action of the electric field in the cell. It is one of the indicators which shows the feasibility to use photoelectrons to trigger the breakdown in the trigger gap 72, even though in reality $V_{pe}$ may not climb so high because breakdown may occur at any time once $V_{pe}$ is equal to or higher than the self-breakdown voltage of the trigger gap 72. To find out the properties of the photoelectron triggering pulse clearly, it is assumed that there is no breakdown in the trigger gap when the following calculations are performed.

(3) The Highest Photoelectron Triggering Energy Stored in the Trigger Electrode

The highest photoelectron triggering energy, $E_{stored}$, is calculated as 28.4 mJ by using the stored energy formula of a capacitor, i.e. $E_{stored}=C_{trig}\times V_{pe}^2/2$. Compared to the 4 mJ optical energy reaching the surface of photocathode, the stored photoelectron electrical energy in the trigger electrode 66 is much higher. It is evident that the triggering energy stored sources from the field acceleration of the photoelectrons in the gap between the photocathode 48 and the anode 56. After the acceleration, the triggering agility of the photoelectron current is greatly enhanced. The amplified triggering energy is the second indicator that the photoelectron pulse is viable to trigger a breakdown in the trigger gap 72.

(4) The Longest Delay Time of the Photoelectron Pulse Relative to the Laser Beam Pulse The delay time comprises two parts: (1) the last electron's transit time from the photocathode 48 to the anode 56; and (2) the electric field propagation time from the anode 56 to the trigger electrode 66. For the first part, an expression of the transit time is derived as below in considering the relativistic effect of the photoelectrons:

$$t = \frac{m_0 c}{eE}\arccos\left(1 - \frac{eEl}{c^2 m_0}\right) \tag{1}$$

where t is the transit time from photocathode 48 to anode 56, $m_0$ is the rest mass of electron, e is the electron's charge, c is the light speed in vacuum, E is the electric field, and l is the distance between said photocathode 48 and said anode 56. The longest transit time is determined by the last photoelectron at the circumstance that it just leaves the photocathode while the potential of the anode 56 is near its lowest, i.e. 34.7 kV, relative to the photocathode 48. The gap distance is 1.5 cm in this example. In such circumstances, it is found that the longest transit time for the photoelectrons is 276 ps. Since electric field propagates at the speed of light in metal, just like that in vacuum, the field propagation time from the anode 56 to the trigger electrode 66 should be less than 333 ps, supposing that the total length of all of the metallic wire connections is less than 10 cm. So the overall longest delay time for the photoelectron pulse to the laser pulse is less than 609 ps, which is still very fast and can be acceptable in many applications.

(5) Minimum Rising Speed of the Trigger Gap Voltage

The voltage, $V_{pe}$, starts to rise once the laser beam reaches the surface of the photocathode 48 and it ends the rising when the field of the last photoelectron reach the trigger electrode. Therefore, the overall rising time of the trigger gap voltage is consisted of the laser pulse duration time and the delay time of the photoelectron pulse relative to the laser beam pulse. From the data in above paragraphs, we know its value is less than 709 ps. So the minimum trigger gap voltage rising speed is 234 kV/ns. The speed is much faster than those of triggering voltage used in conventional trigatron switches and field distortion switches. The latter ones are comparably difficult to be made higher than 100 kV/ns. The fast rising speed of the trigger gap voltage is another indicator of the feasibility of the photoelectron triggering pulse, too.

The calculations above also indicate that the triggering voltage pulse originating from the photocurrent is capable of triggering the high voltage switch by itself, even if the laser beam is not used as the first trigger pulse to pass through the main spark gap 74.

In addition, the number of photoelectrons extracted and the capacitance between the circuit of the trigger electrode 66 and the main electrode 34 are the two critical factors to induce electrical breakdown. To enhance the photoelectron pulse triggering reliability, a photocathode with high quantum efficiency and a small capacitance are desired.

Figure 4:
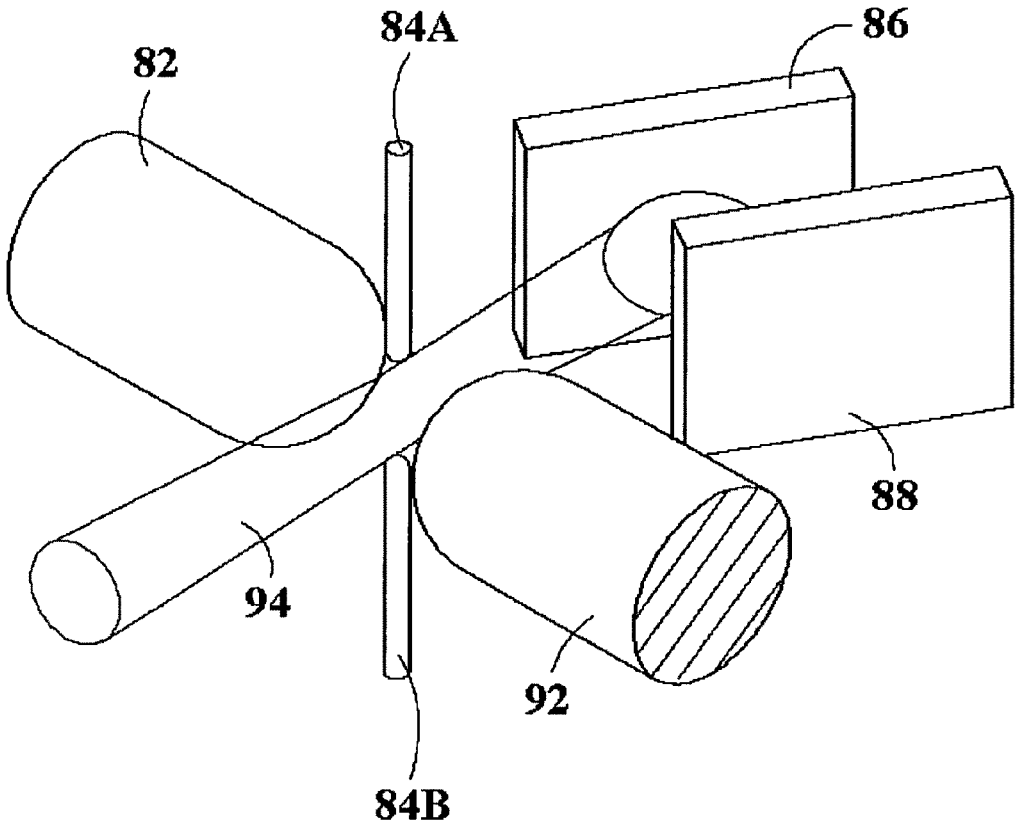
FIG. 4 is a perspective view of the second embodiment of the present invention.

Referring to FIG. 4, the second embodiment of present invention, a field distortion type switch, is illustrated. Only the relative positions of all key components of the switch are plotted in FIG. 4 since the second embodiment is similar to the first embodiment in many aspects such as the housing format, the material and position of the high vacuum cell, the support and electrical connections of the photocathode 86 and the anode 88, and the direction of the laser beam 94. The differences between the two embodiments are the number and the position arrangement of the trigger electrodes. In the second embodiment, two trigger electrodes 84A and 84B are utilized, instead of the only one trigger electrode in the first embodiment, and the two trigger electrodes 84A and 84B are set into the main spark gap defined by the main electrodes 82 and 92, unlike the trigger electrode in the first embodiment, whose position is inside the higher potential main electrode. The two electrodes 84A and 84B are set at upper and lower positions of the laser beam individually and are near the higher potential main electrode 92 for triggering the breakdown easily. The advantage of this arrangement is that the trigger gap is a part of the main spark gap, which makes the main spark gap easier to be broken down. Furthermore, a very large portion of the trigger electrode rods in the second embodiment is far from the main electrode 92 except the tips of the rods. This fact is helpful to reduce the capacitances there between and therefore is benefit to raise the trigger gap voltage.

While the invention has been described with reference to its preferred embodiments, those skilled in the art will understand that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A spark gap switch comprising a pair of main electrodes, a plurality of trigger electrodes, a photocathode and a high vacuum cell, all located inside a sealed housing;

wherein the spark gap switch is doubly or multiply triggered by a first ionization of a dielectric medium between the main electrodes upon a passing of an energetic beam through the dielectric medium in a main spark gap, and by a second and subsequent ionization of the dielectric medium by using a leftover energy of the energetic beam incident on the photocathode, thereby enhancing and completing a voltage breakdown of the dielectric medium between the main electrodes so that a minimum trigger gap voltage rising speed is 234 kV/ns and said switch can be closed with a low delay time, low jitter and high efficiency of optical trigger energy.

2. A spark gap switch as described in claim 1 wherein the voltage breakdown of the trigger gap induced by photoelectrons exports a large number of active ions to the main spark gap and cause the main spark gap to close reliably in a very short time.

* * * * *